US005082069A

United States Patent [19]

Seiler et al.

[11] Patent Number: 5,082,069

[45] Date of Patent: Jan. 21, 1992

[54] COMBINATION DRIVEPIPE/CASING AND INSTALLATION METHOD FOR OFFSHORE WELL

[75] Inventors: Nancy J. Seiler, Houston; Junius D. Allen, Dallas; James E. Jackson, Pearland; Samuel C. Lynch, Houston, all of Tex.

[73] Assignee: Atlantic Richfield Company, Los Angeles, Calif.

[21] Appl. No.: 487,484

[22] Filed: Mar. 1, 1990

[51] Int. Cl.[5] ..... E21B 7/20

[52] U.S. Cl. ..... 175/5; 175/171; 175/325

[58] Field of Search ..... 166/360, 380, 77, 242; 175/5, 19, 171, 257, 320, 325

[56] References Cited

U.S. PATENT DOCUMENTS 3,193,918 7/1965 Heldenbrand ..... 175/325 X
3,425,757 2/1969 Minor ..... 175/325
3,525,224 8/1970 Bardgette ..... 175/171 X
4,544,041 10/1985 Rinaldi ..... 175/171 X
4,796,670 1/1989 Russell et al. ..... 175/325 X

*Primary Examiner*—William P. Neuder

[57] ABSTRACT

Offshore wells are drilled with an improved drivepipe/casing assembly made up of plural sections of casing connected end to end, which are driven to a predetermined depth followed by drilling out a wellbore portion below the lower distal end of the casing assembly and then followed by redriving the drivepipe/casing assembly to refusal to eliminate the need for a conventional casing string and associated cementing operations. Certain ones of the casing sections are provided with earth impinging and displacing rings of slightly larger diameter than the outside diameter of the casing to reduce earth to casing friction during driving and to minimize the redriving effort required.

11 Claims, 1 Drawing Sheet

COMBINATION DRIVEPIPE/CASING AND INSTALLATION METHOD FOR OFFSHORE WELL

BACKGROUND OF THE INVENTION

1. Field of the Invention

The present invention pertains to a method of installing a combination drivepipe and casing string in an offshore well, using an improved drivepipe/casing assembly.

2. Background

Conventional practice in installing so-called drivepipe in offshore wells comprises driving a relatively large diameter string of pipe into the mud until refusal is encountered followed by conventional well drilling practices which are carried out through this so-called drivepipe or outer casing string by drilling successively smaller diameter holes and alternately setting casing strings until the desired hole depth is obtained. The drivepipe (also sometimes referred to as conductor or structural pipe) becomes the conduit for guiding the drillstring and serves as a conduit for fluids, such as drilling mud, which are returned to the surface during drilling operations.

The process of rigging up and rigging down for drilling, then setting casing, then drilling again is time consuming, expensive and subject to certain hazards. Accordingly, there has been a never-ending search for methods and apparatus to improve the well drilling and completion process, particularly with respect to the expensive, more hazardous and environmentally sensitive situations encountered in drilling and encasing offshore wells. The present invention is directed to an improved combination drivepipe and casing assembly as well as a unique method of driving, drilling and driving to final installation of a casing assembly and which overcomes several of the disadvantages of prior art practices.

SUMMARY OF THE INVENTION

The present invention provides for a combination drivepipe and casing assembly for use in drilling offshore oil and gas wells and a unique method for drilling such wells.

In accordance with an important aspect of the present invention, a unique drivepipe installation method is provided for offshore well drilling wherein selected sections of drivepipe or casing are provided with means in the form of an impingement ring disposed on the outer cylindrical surface of the drivepipe at selected intervals on the drivepipe string. The selective placement of these impingement or "hole opener" rings reduces friction between the drivepipe and the earth formation to facilitate continued driving of the pipe during performance of the improved method in accordance with the present invention.

In accordance with another aspect of the present invention, a unique method of drilling an offshore well is provided wherein a drivepipe or outer casing is first driven to a predetermined depth followed by conventional drilling of a portion of the wellbore below the lower distal end of the drivepipe and then followed by encasing the wellbore by further driving of the drivepipe to a specified depth, or to refusal, so as to extend the drivepipe to thereby replace a conventional casing string and associated cementing procedure. This method eliminates the process of installing at least one casing string in the well and maintains a larger casing inner diameter to a greater depth. The outer casing or drivepipe thus serves as the first casing string to a greater total depth than is provided in accordance with conventional well drilling procedures.

The present invention further provides a method to deepen the refusal point of drivepipe and eliminate at least one shallow casing string on offshore well installations.

Those skilled in the art will further appreciate the abovementioned advantages and superior features of the present invention together with other aspects thereof upon reading the detailed description which follows in conjunction with the drawing.

DESCRIPTION OF PREFERRED EMBODIMENTS

Figure 3:
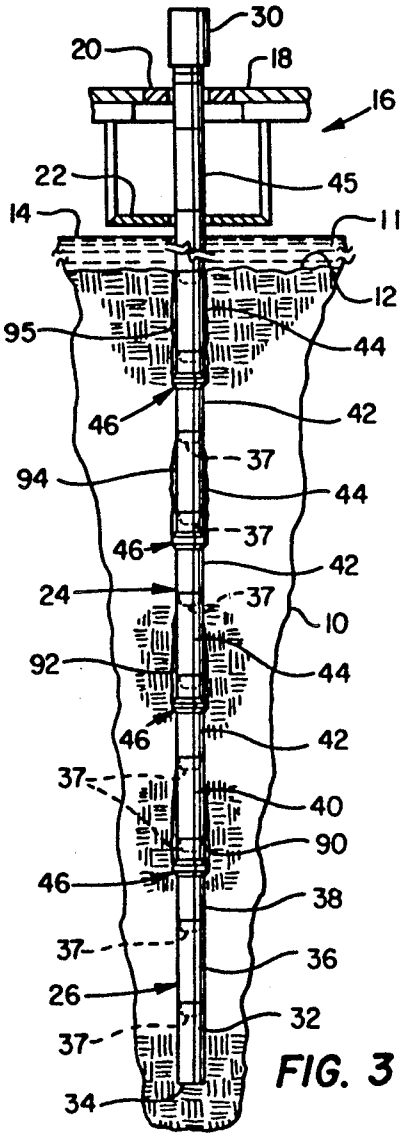
FIG. 3 is a diagram similar to FIGS. 1 and 2 showing still a further step in the method according to the present invention.

In the description which follows, like parts are marked throughout the specification and drawing with the same reference numerals, respectively. The drawing figures are not intended to be to scale and certain elements are shown in somewhat schematic or generalized form in the interest of clarity and conciseness.

Figure 1:
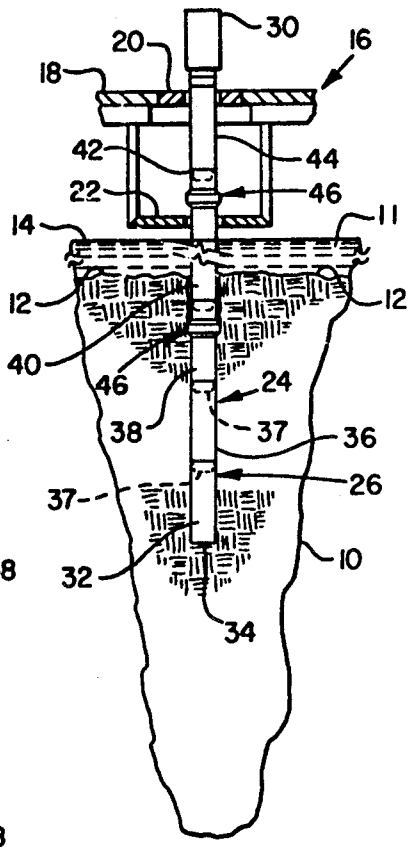
FIG. 1 is a diagram comprising a vertical section view in somewhat schematic form of a well wherein a unique drivepipe/casing string is being driven to installation by a method in accordance with the present invention.

Referring to FIG. 1, there is shown a portion of an earth formation 10 disposed below a body of water 11 and having an interface with said body of water at a so-called mud line 12. The surface of the body of water is represented by the numeral 14 and a portion of a conventional offshore drilling rig 16 is illustrated including a drill floor 8, and conventional rotary drillstem driving means 20 disposed thereon. A lower level deck 22 of the drilling rig 16 is also illustrated in somewhat schematic form and disposed a relatively short distance above the water line 14. Other portions of the drilling rig 16 are not illustrated and further description of the drilling rig is not believed to be necessary for an understanding and practice of the present invention.

FIG. 1 further illustrates the formation of a well 24 which is initially being carried out by the driving of a unique elongated cylindrical combination drivepipe/casing assembly 26. The drivepipe/casing assembly 26 is shown in the condition wherein, in the view of FIG. 1, the casing assembly is being driven into the formation 10 by a conventional drive hammer 30 similar to a conventional pile driver. The driving hammer 30 may be suspended from the rig travelling block assembly, not shown, or otherwise rigged up to drive the drivepipe/casing assembly 26 in a conventional manner. In the condition of FIG. 1, the drivepipe/casing assembly 26 includes a first casing section 32 having a lower distal end 34 with a beveled end wall or shoe formed in a conventional manner. The casing section 32 is also provided with suitable means for connecting it to a second casing section 36, for example, a flush joint type connection formed by conventional threaded pin and box type connectors, to form a connection 37. In like manner, the casing section 36 is threadedly connected to a casing section 38 and so on, including casing sections, as shown in FIG. 1, indicated by the numerals 40, 42 and 44. At least every other or every third casing section in the drivepipe/casing assembly 26 above the sections 32 and 36 is configured similar to the casing section 38 in that an impingement means 46 is formed thereon for plowing or displacing the earth material at least partially and somewhat radially away from the outer surface of the casing.

Figure 5:
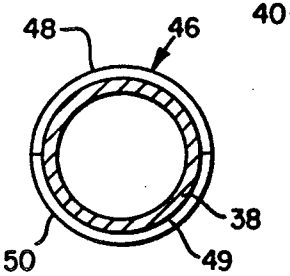
FIG. 5 is a section view taken along the line 5—5 of FIG. 4.
Figure 4:
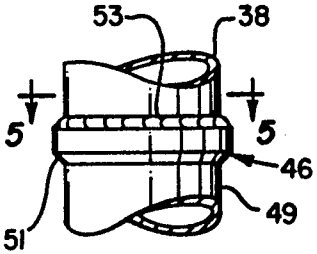
FIG. 4 is a detail elevation of part of one of the casing sections of the impingement or hole opener rings disposed thereon.

In a preferred embodiment of the drivepipe/casing sections in accordance with the present invention, the impingement means 46 is characterized by a cylindrical ring or collar as shown in FIGS. 4 and 5 comprising semi-circular ring sections 48 and 50 which have at least one beveled edge 51 facing the direction of entry of the ring into the earth formation. The impingement rings 46 are preferably disposed intermediate the opposed ends of the smooth walled, constant diameter cylindrical casing sections 38, 42 and so on. Each impingement ring 46 is preferably welded to the outer cylindrical surface 49 of the casing sections 38 and 42 as well as the other casing sections to be described herein which include an impingement ring thereon, which weld is indicated by the numeral 53 in FIG. 4, for example. The impingement ring 46 may also be integrally formed with each of the casing sections or secured thereto in other ways. Still further, it is contemplated that the advantages derived from the impingement rings 46 may be obtained in other ways, although possibly not in the superior manner experienced with the arrangement shown and described herein.

Figure 2:
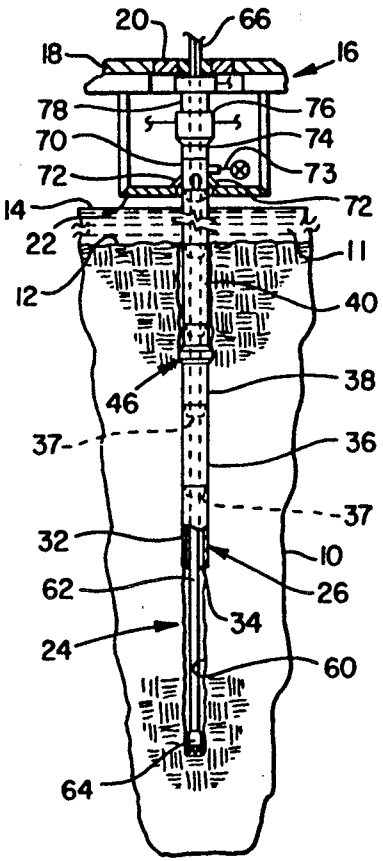
FIG. 2 is a diagram similar to FIG. 1 showing a further step in the method in accordance with the present invention.

As indicated in FIG. 1, when a casing section 38 is introduced into the drivepipe/casing assembly 26 and driven into the earth formation 10 the effect is to tend to move back the surface of the earth formation to minimize the frictional resistance to driving which is encountered between the surface of the casing assembly and the earth material through which the casing assembly is being driven. This facilitates the act of initiating a second driving cycle for further driving of the casing assembly 26 to a predetermined depth corresponding to the depth at which the next, smaller diameter, conventional casing string, not shown, would be set. As the casing assembly 26 is made up by the addition of casing sections 40, 42, 44 and so on, it has been determined that every other or every third casing section above the two lowermost sections may advantageously include at least one impingement ring 46 thereon. This is indicated in FIGS. 1 through 3 by the casing section 42 in FIGS. 1 and 2 and by the further casing sections 42 in the extended drivepipe/casing assembly 26, as shown in FIG. 3. The increase in the diameter of each casing section as provided by the rings 46 may vary but an increase in diameter in the amount of about five percent to eight percent may be advantageous. For example, for a casing assembly 26 having an outer diameter of about 30.0 inches an impingement ring 46 having an outer diameter of about 32.0 inches has been found to provide sufficient loosening and displacement of the soil around the casing assembly while not adversely affecting the conventional driving effort required to drive the casing into the formation 10 in the first place. In many installations the two lowermost casing sections are not provided with a ring 46 so as to maintain an effective fluid tight seal between the earth formation and the drivepipe/casing assembly to prevent fluids from migrating to or from the wellbore.

Once the drivepipe/casing assembly 26 is initially driven to a predetermined depth, as indicated by the position of the casing assembly shown in FIG. 2, the driving hammer 30 is removed from the upper end of the casing assembly and certain components are attached to the casing assembly above the water line 14 to prepare for conventional drilling of the well 24 to a depth which may correspond to the setting depth of the next smaller diameter casing string, not shown. A portion of this additional wellbore is indicated by the numeral 60. Drilling may be carried out with a conventional drillstem 62 and bit 64 run into the well through the casing assembly 26 and driven from the surface such as by a conventional rotary kelly 66 which is rotated by the rotation means 20. The drillstem 62 may also be rotated by other means such as a so-called top drive arrangement, not shown. The diameter of the wellbore 60 is typically slightly less than the inside diameter of the drivepipe/casing assembly 26. In the example abovedescribed for use of a 30.0 inch outside diameter casing having a 28.0 inch inside diameter, a drill bit diameter of 26.0 inches is indicated to be suitable for further extension of the well 24 into the formation 10. The formation characteristics may determine how far the wellbore portion 60 is drilled before redriving of the casing assembly 26 is initiated.

In rigging up for drilling out the wellbore portion 60, the upper end of the drivepipe/casing assembly 26 is fitted with a riser member 70 which may have radially extending gussets 72 installed on the outside diameter thereof and which may be engaged with the deck 22 to assist in supporting the casing assembly 26. This prevents unwanted falling of the casing assembly 26 during the drilling operation since the casing assembly was not previously driven to refusal. The upper end of the riser member 70 is preferably fitted with a suitable quick release connector 74 to expedite connecting and disconnecting the riser member 70 to a conventional oil and gas well diverter mechanism 76. A bell nipple 78 is also connected above the diverter 76 for use during the drilling operation while circulation of drilling fluid is carried out down through the drillstem 62 and up the annulus formed between the wellbore portion 60, the interior of the casing assembly 26, the riser member 70, bell nipple 78 and the drillstem.

When the wellbore portion 60 has been drilled to the depth prescribed, the drillstem 62 is removed from the interior of the drivepipe/casing assembly 26, and the riser member 70 together with the connector 74, diverter 76 and bell nipple 78 are also removed from the upper end of the casing assembly 26. Additional sections of casing are then interconnected with the casing assembly 26 together with the drive hammer 30 to continue driving the drivepipe/casing assembly 26 into the formation 10. At least initially, after removing the riser section 70, the low resistance to movement of the drivepipe/casing assembly 26 further into the formation 10 may result in only slight effort to initiate redriving, thanks to forming the wellbore portion 60 of a diameter only slightly less than the inside diameter of the drivepipe/casing assembly, and the provision of the impingement rings 46 on selected ones of the casing sections.

FIG. 3 illustrates the drivepipe/casing assembly 26 having been driven still further into the formation 10 to the setting depth of the next casing string, not shown, and with the addition of further casing sections 42 and 44 as the assembly is lengthened. Again, by driving the drivepipe/casing assembly 26 with the impingement rings 46 on the alternate casing sections 42, the formation material is at least opened or displaced away from strong frictional engagement with the drivepipe/casing assembly along at least certain portions thereof as indicated by the areas 90, 92, 94 and 95 in FIG. 3. As the drivepipe/casing assembly 26 is driven into the earth 10, earth material is pushed away from tight engagement with the outside diameter of the casing assembly at least partially therealong. Depending on the formation characteristics, the earth material may tend to close back into engagement with the drivepipe/casing assembly 26 at certain points but at least the friction forces between the casing assembly and the earth are reduced to facilitate further driving. In the foregoing manner, a drivepipe/casing assembly such as the assembly 26 may be driven to a greater depth in the wellbore than has heretofore previously been obtainable, thereby eliminating a subsequent conventional casing string and cementing operation in the overall well plan and providing a larger diameter surface casing string extending to a greater depth.

By way of example, relatively deep, long step out wells have been drilled into certain formations in the Gulf of Mexico in waters of about 450 foot depth by initially driving 30.0 inch outside diameter by 1.0 inch wall thickness drivepipe/casing having the configuration of the drivepipe/casing assembly 26 and its component parts threadedly coupled together by driving the casing assembly 26 to a predetermined depth, then installing the riser 70, diverter 76 and bell nipple 78, as illustrated in FIG. 2, and conventionally drilling a hole to form a wellbore portion 60 of a diameter slightly smaller than the inside diameter of the casing assembly to a prescribed depth. As shown in FIG. 2, for example, after drilling out the wellbore portion 60 to the prescribed depth, the riser member 70 and the riser members and other mechanism above the riser member 70 are drained of drilling fluid through conduit means 73 having a suitable shutoff valve connected thereto and then the riser member 70 and the components connected thereto above are disconnected from the casing assembly 26. Additional casing sections, such as sections 42, 44 and 45, are then added to the assembly 26 to put the top end of the assembly 26 above the drill floor 18 whereby the drive hammer 30 may be reconnected. Conventional casing slips are preferably kept in readiness in the event that the casing assembly 26 begins a free fall into the wellbore due to low resistance to holding of the casing assembly 26 in place by the formation 10. The casing assembly 26 is then driven to refusal, the drive hammer 30 rigged down and a riser assembly similar to that illustrated in FIG. 2 rigged up to the upper end of the casing assembly to resume drilling operations in a conventional manner. The abovedescribed drivepipe/casing assembly 26 and the method of the present invention may be carried out using the modified and unique casing sections 38 and 42 which are otherwise relatively conventional and are made of conventional engineering materials for such components. Each casing section is provided with a suitable threaded box end and pin end connector portion at opposite ends thereof. As previously mentioned, the impingement rings 46 may be integrally formed on the respective casing sections 38 and 42 or added as the casing sections are added to the casing assembly.

Although a preferred embodiment of an improved drivepipe/casing assembly and a unique method for installation of same has been described in detail hereinabove, those skilled in the art will recognize that various substitutions and modifications may be made to the assembly and method of the present invention without departing from the scope and spirit thereof as defined by the appended claims.

What is claimed is:

1. A method for installing a drivepipe/casing string in an offshore well comprising the steps of:

providing a multi-section drivepipe/casing assembly including end to end connected casing sections;

lowering said casing assembly into an earth formation;

connecting driving hammer means to said casing assembly and driving said casing assembly to a predetermined depth;

inserting a drillstring and bit assembly into said casing assembly;

drilling a wellbore portion with said drillstring and bit assembly into said formation below the lower distal end of said casing assembly to a selected depth; and redriving said casing assembly to a further predetermined depth beyond said first predetermined depth.

2. The method set forth in claim 1 including the step of:

drilling said wellbore portion of a diameter slightly less than the inside diameter of said casing assembly.

3. The method set forth in claim 1 including the step of:

providing selected sections of said casing assembly with means thereon for displacing said earth formation at least partially away from the outside surface of said casing assembly during driving thereof.

4. The method set forth in claim 3 including the step of:

providing a predetermined length of said casing section above the lower distal and thereof as a generally cylindrical smooth walled portion of said casing assembly.

5. The method set forth in claim 3 wherein:

alternate ones of sections of said casing assembly are provided with said means for displacing.

6. A method for installing a drivepipe/casing string in an offshore well comprising the steps of:

providing a multi-section drivepipe/casing assembly including end to end connected casing sections wherein selected ones of said sections include generally cylindrical ring means thereon for displacing an earth formation at least partially away from the outside surface of said casing assembly during driving thereof;

lowering said casing assembly to said earth formation;

connecting driving hammer means to said casing assembly and driving said casing assembly to a predetermined depth;

inserting a drillstring and bit assembly into said casing assembly;

drilling a wellbore portion with said drillstring and bit assembly into said formation below the lower distal end of said casing assembly, said wellbore portion having a diameter slightly less than the inside diameter of said casing assembly; and redriving said casing assembly to refusal.

7. The method set forth in claim 6 wherein:

alternate ones of sections of said casing assembly are provided with said means for displacing.

8. A drivepipe/casing assembly for driving into an earth formation to form a cased portion of a wellbore including:

a plurality of end to end connected generally cylindrical casing sections having a generally cylindrical outer wall surface and wherein at least selected ones of said casing sections have means thereon for displacing the earth generally radially away from said outer surface, said means for displacing comprising a generally cylindrical ring disposed on the outer surface of said selected ones of said casing sections, respectively, and having an outer diameter in the range of about 5 percent to 8 percent greater than the outer diameter of said casing assembly.

9. The casing assembly set forth in claim 8 wherein:

said ring is split in at least two parts and is welded to the outer surface of said selected ones of said casing sections.

10. The casing assembly set forth in claim 9 wherein:

said ring includes an axially extending beveled portion facing the direction of driving of said casing assembly.

11. A drivepipe/casing assembly for driving into an earth formation to form a cased portion of a wellbore including:

a plurality of end to end connected generally cylindrical casing sections having a generally cylindrical outer wall surface and wherein at least selected ones of said casing sections above at least the lowermost distal casing section have means thereon for displacing the earth radially away from said outer surface, said means for displacing comprising a generally cylindrical ring on the outer surface of said selected ones of said casing sections and having an outer diameter in the range of about 5 to 8 percent greater than the diameter of said casing assembly.

* * * * *